US005860823A

United States Patent [19]

Samejima et al.

[11] Patent Number: 5,860,823

[45] Date of Patent: Jan. 19, 1999

[54] MOVABLE CONNECTOR WITH ROTATION LIMITING STRUCTURE

[75] Inventors: Masakuni Samejima; Hideto Kumakura, both of Shizuoka, Japan

[73] Assignee: Yazaki Corporation, Tokyo, Japan

[21] Appl. No.: 723,352

[22] Filed: Sep. 30, 1996

[30] Foreign Application Priority Data

Sep. 29, 1995 [JP] Japan ..... 7-253506

[51] Int. Cl.[6] ..... H01R 13/73

[52] U.S. Cl. ..... 439/248; 439/567

[58] Field of Search ..... 439/567, 571, 439/572, 573, 554, 557, 247, 248

[56] References Cited

U.S. PATENT DOCUMENTS

| | | | |
|---|---|---|---|
| 4,053,199 | 10/1977 | Hollyday et al. | 439/572 |
| 4,173,387 | 11/1979 | Zell | 439/557 |
| 4,588,854 | 5/1986 | Bailey et al. | 174/52 |
| 4,824,398 | 4/1989 | Taylor | 439/557 |
| 4,827,609 | 5/1989 | Kawecki | 29/832 |
| 5,199,896 | 4/1993 | Mosquera | 439/557 |
| 5,338,226 | 8/1994 | Bruce et al. | 439/571 |
| 5,407,363 | 4/1995 | Polgar et al. | 439/546 |
| 5,634,810 | 6/1997 | Niitsu et al. | 439/567 |

FOREIGN PATENT DOCUMENTS

| | | | |
|---|---|---|---|
| 0584577 | 2/1994 | European Pat. Off. | 439/537 |
| 0 713 998 | 5/1996 | European Pat. Off. . | |
| 62-37232 | 2/1987 | Japan . | |
| A-64-51276 | 3/1989 | Japan . | |
| A-5-121121 | 5/1993 | Japan . | |
| 5-43484 U | 6/1993 | Japan . | |
| 5-50610 | 7/1993 | Japan . | |
| 5-53157 U | 7/1993 | Japan . | |
| 550610 | 7/1993 | Japan . | |

*Primary Examiner*—Neil Abrams
*Attorney, Agent, or Firm*—Sughrue, Mion, Zinn, Macpeak & Seas, PLLC

[57] ABSTRACT

A rotation preventing structure adapted to regulate the excessive rotation of a movable connector 31 is disclosed. During connection, the position of the connector may shift so as to align with a mating connector. A structure is disclosed which limits such a shift. The structure comprises: a rectangular mounting hole 43 formed in a mounting member 41; a supporting board 35 coupled to a connector housing 33; a locking member 37 protruded from one surface of the supporting board 35, the locking member being inserted into the mounting hole 43 and locked to the mounting hole 43; and rotation regulating means 47 and 49 provided on the mounting member and the supporting board 35 to regulate the rotation of the movable connector about the inserting central axis c of the locking member 37. The rotation regulating means may include protrusions 47 locatable on either the support board 35 or on the mounting member 41.

6 Claims, 5 Drawing Sheets

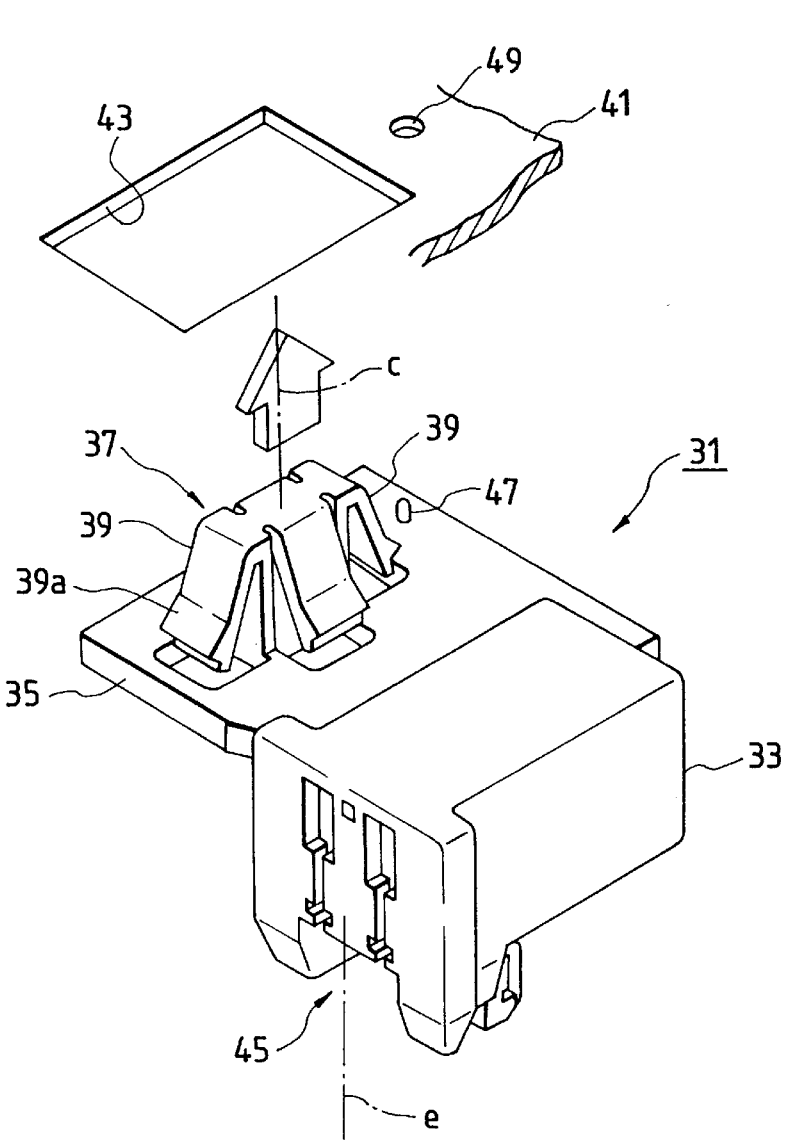
FIG. 2
FIG. 9
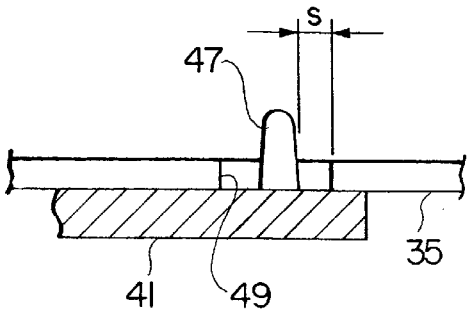
FIG. 3
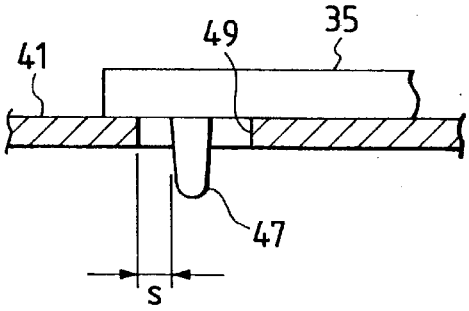

MOVABLE CONNECTOR WITH ROTATION LIMITING STRUCTURE

BACKGROUND OF THE INVENTION

1. Field of the Invention

This invention relates to a rotation preventing structure for limiting the rotation of a movable connector (hereinafter referred to as "a movable-connector rotation preventing structure", when applicable).

2. Description of Relevant Art

A variety of electrical devices are mounted on vehicles, such as automobiles, which require the supply of electric power. For instance, an interior lamp is generally mounted as shown in FIG. 5. That is, a vehicle-body-side connector 3 connected to an electrical wire 1 is mounted on a roof board 5, while the lamp 9 has a lamp-side connector 7 to be engaged with the vehicle-body-side connector 3. Hence, simultaneously to when the lamp 9 is installed, the lamp-side connector 7 is electrically connected to the vehicle-body-side connector 3. With the above-described structure, in engaging the two connectors 3 and 7 to each other, it is necessary to move the vehicle-body side connector 3 so as to be aligned with the position of the lamp-side connector 7.

Hence, a so-called "movable connector" has been proposed in the art which is movable to overcome the relative positional shift of the two connectors during the installation of the lamp. As shown in FIG. 6, the movable connector has four elastic locking pieces 13, provided respectively on four sides of a rectangular-box-shaped connector housing. The elastic locking pieces 13 have locking protrusions 13*a* at the outer ends thereof, respectively. The locking protrusions 13*a* are locked to the edge of a rectangular mounting hole 15, to mount the movable connector on the roof board 5.

As is apparent from the above description, the movable connector 11 is secured to the mounting hole 15 with the aid of the elastic locking pieces 13. Hence, the elastic deformation of the elastic locking pieces 13 allows the movable connector 11 to slightly rotate, thus correcting any positional shift of the movable connector with respect to the mating connector (not shown).

In the case of the above-described movable connector 11, the four locking protrusions 13*a* are locked to the four edges of the rectangular mounting hole 15 by the elastic forces of the four elastic locking pieces provided on the four sides of the connector housing. Hence, when an external force acts on the movable connector 11 to turn the latter about the inserting central axis c of the connector 11, the pairs of elastic locking pieces 13 which are confronted with each other are bent inwardly (towards each other), so that the movable connector 11 is turned with ease. If the movable connector 11 is turned excessively in this manner, then it is difficult to correct the positional shift of the movable connector with respect to the mating connector, and it is impossible to engage the two connectors with each other.

On the other hand, a movable connector 23 as shown in FIG. 8 has been developed by the present inventors, in which the inserting central axis c of a locking section 19 is not the same as the fitting central axis e of a connector 21. If the locking section 19 is turned about the inserting central axis c, the connector 21 is moved circularly with the locking section 19 as the center, thus being greatly shifted. In this case, a difficulty is involved that, although the electrical device is mounted, the connector 21 is not fitted to the locking section 19.

If the locking section 19 is turned excessively, then the elastic locking pieces 13 are twisted, so that the locking pieces 13 and the connector 21 may be damaged.

In view of the foregoing, an object of the invention is to provide a rotation preventing structure for a movable connector which prevents the movable connector from being turned beyond a predetermined range of angles, to thereby enhance the function of correcting the positional shift of the movable connector, and to prevent the connector housing from damage.

SUMMARY OF THE INVENTION

The foregoing object of the invention has been achieved by the provision of a rotation preventing structure adapted to regulate the excessive rotation of a movable connector. The arrangement according to the invention comprises:

a rectangular mounting hole formed in a mounting member of the car (e.g. in the roof bow);

a supporting board coupled to a connector housing;

a locking member protruded from one surface of the supporting board, the locking member being inserted into the mounting hole and locked to the mounting hole; and rotation regulating means provided on the mounting member and the supporting board, to regulate the rotation of the movable connector about the inserting central axis of the locking member.

In the rotation preventing structure according to a preferred embodiment, the rotation regulating means comprises: a protrusion extended from the supporting board in the same direction as the locking member; and a hole formed in the mounting member, the hole engaging with the protrusion when the locking member is locked to the mounting hole. The inside diameter of the hole is made larger than the outside diameter of the protrusion, in correspondence to an amount of movement of the movable connector.

Hence, with the rotation preventing structure of the invention, when the movable connector is mounted on the mounting member, the protrusion of the supporting board is inserted into the hole of the mounting member in such a manner that the protrusion is coaxial with the hole. In engaging the movable connector with the mating connector, the movable connector is moved through the displacement of the clips (or elastic locking pieces), so that the positional shift of the movable connector with respect to the latter is absorbed. Even if, in this operation, a great moment acts on the movable connector to turn the movable connector beyond the predetermined range of angles, the protrusion abuts against the edge of the hole, thus positively preventing the movable connector from being turned beyond the predetermined range of angles.

BRIEF DESCRIPTION OF THE DRAWINGS

FIG. 2 is an exploded perspective view of a movable connector shown in FIG. 1 which is going to be mounted on a roof board.

FIG. 3 is a sectional view showing essential components of the movable-connector rotation preventing structure shown in FIG. 1.

Figure 1:
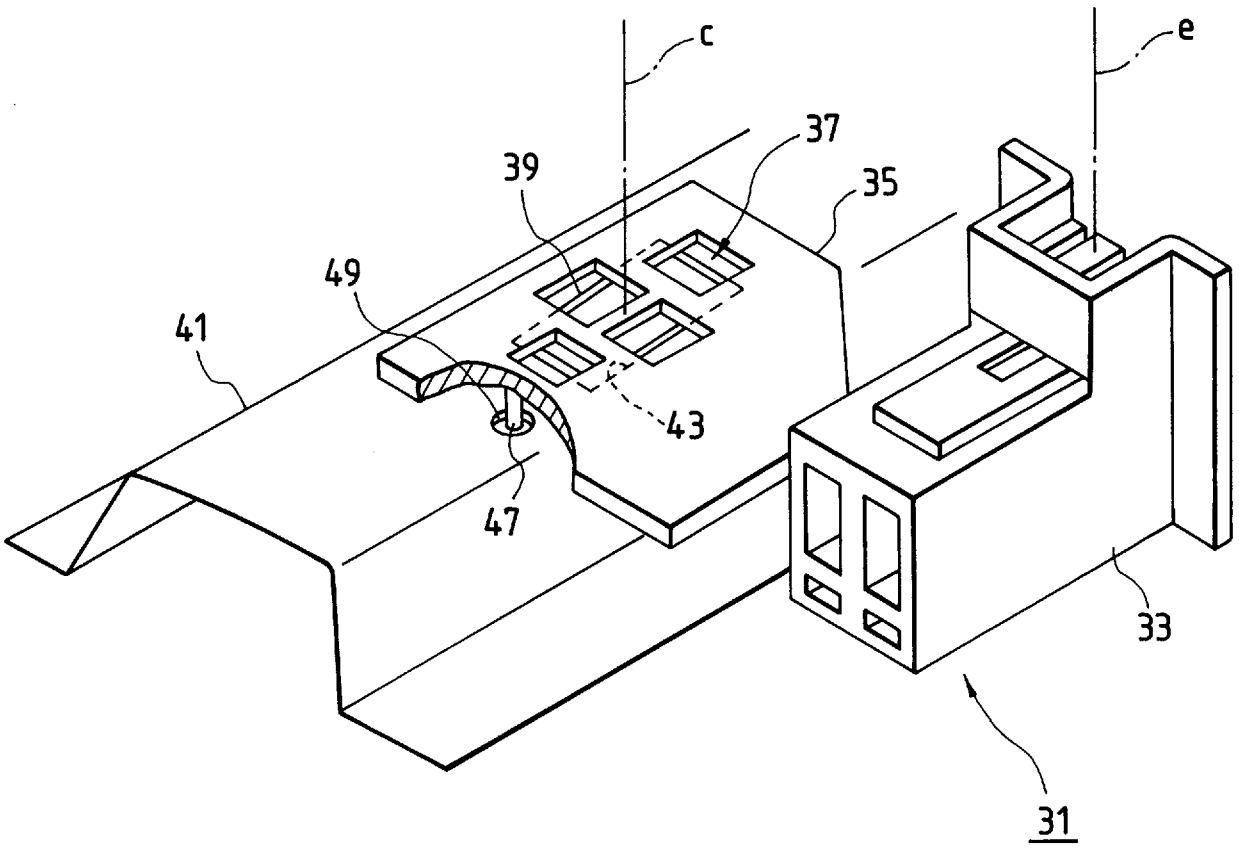
FIG. 1 is a perspective view showing a movable-connector rotation preventing structure according to the invention.
Figure 4A:
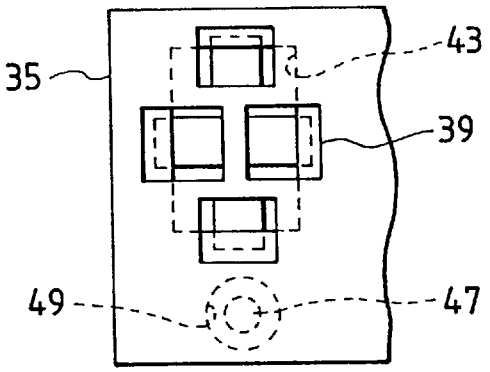
Figure 4B:
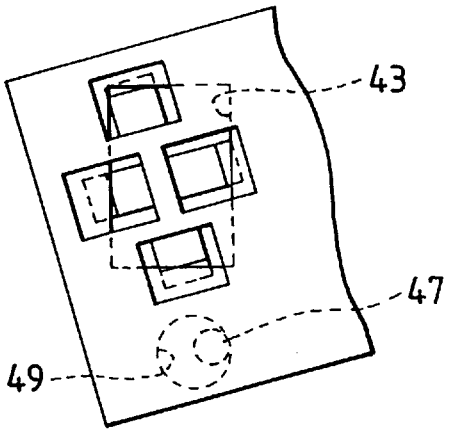

The parts (A) and (B) of FIG. 4 are a plan views for a description of the effect of turn of the movable connector shown in FIG. 1.

Figure 5:
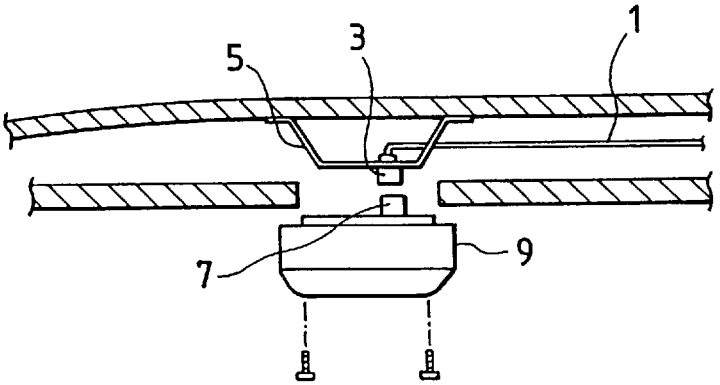
PRIOR ART FIG. 5

FIG. 5 is a sectional view showing a room-lamp mounting structure.

Figure 6:
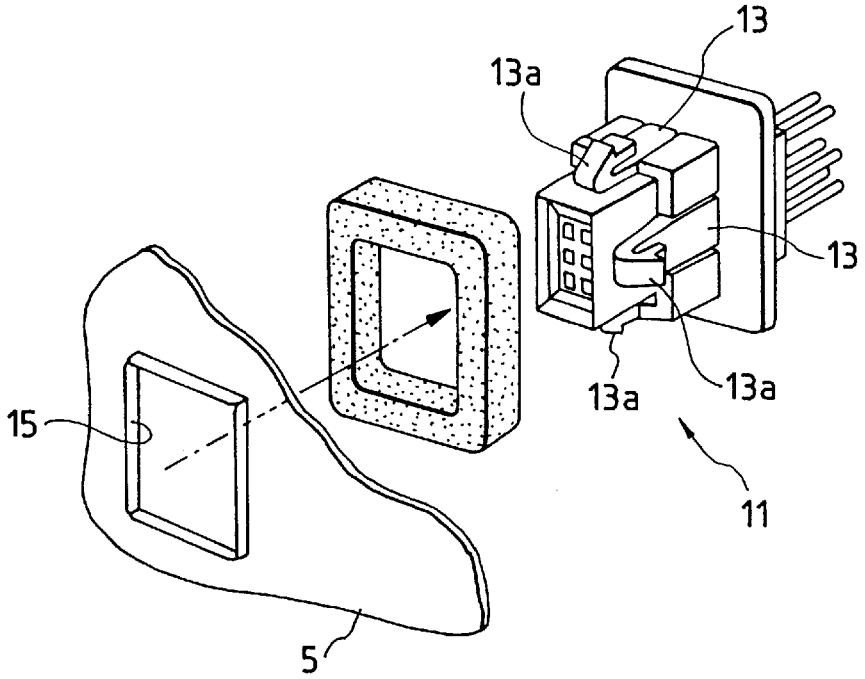
PRIOR ART FIG. 6

FIG. 6 is an exploded perspective view showing a conventional movable connector.

Figure 7:
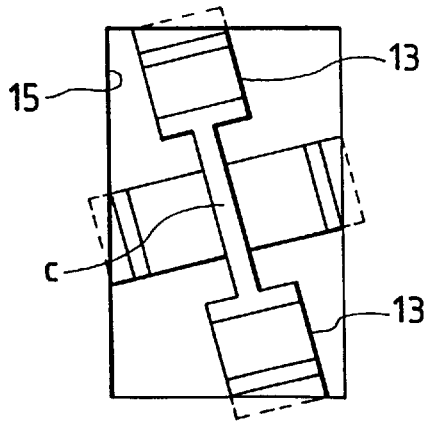
PRIOR ART FIG. 7

FIG. 7 is a plan view for a description of the effect of turning of the conventional movable connector.

Figure 8:
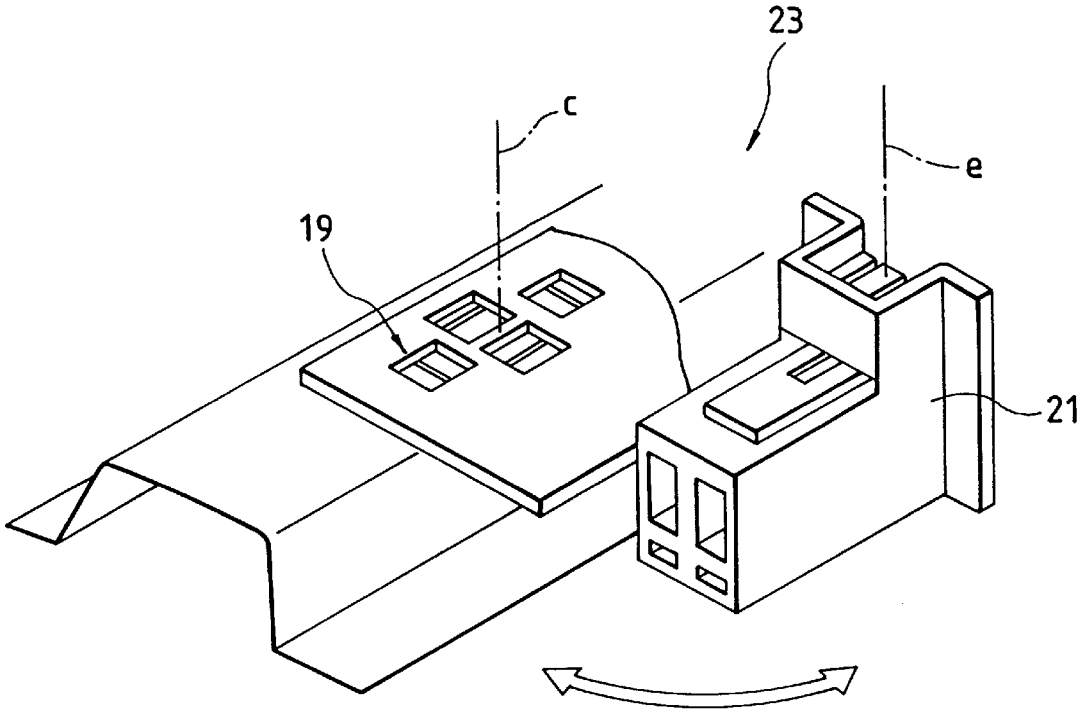
PRIOR ART FIG. 8

FIG. 8 is a perspective view for a description of the effect or turning of another conventional movable connector.

FIG. 9 is a sectional view showing essential components of the movable-connector rotation preventing structure in a reverse arrangement as shown in FIG. 3.

DETAILED DESCRIPTION OF THE PREFERRED EMBODIMENTS

A rotation preventing structure for a movable connector (hereinafter referred to as "movable-connector rotation preventing structure", when applicable), which is a preferred embodiment of the invention, will be described with reference to FIGS. 1 through 4 in detail.

FIG. 1 is a perspective view of the movable-connector rotating preventing structure of the invention, FIG. 2 is an exploded perspective view of a movable connector which is in a position to be installed, FIG. 3 is an enlarged sectional view of essential parts shown in FIG. 1, and FIG. 4 is a plan view for a description of the movement of the movable connector.

As shown in FIGS. 1 and 2, the movable connector 31 has a connector housing 33 with a supporting board 35 which is laterally extended, forming right angles with the fitting central axis e of the movable connector 31. The supporting board 35 has a locking member 37 on its upper surface. The locking member 37 includes four elastic locking pieces 39 (hereinafter referred to as "clips 39", when applicable) which are extended in four different directions and have locking protrusions 39*a* at the ends, so that the movable connector 31 is locked when the locking protrusions 39*a* are engaged with the four edges of a rectangular mounting hole 43 formed in the roof board 41.

The four clips 39 have base end portions which are integral with one another, and front end portions, namely, free end portions which are sloped downwardly. In engaging the locking member 37 with the mounting hole 43, the locking member 37 is inserted into the mounting hole 43 beginning with the base end portions which are integral with one another. In the movable connector 31, a fitting surface 45 is provided on the side of the connector housing 33 which is opposite to the side to which the clips 39 are protruded.

The aforementioned supporting board 35 has a protrusion 47 which is extended in the same direction as the clips 39. In addition, a hole 49 is formed in the roof board 41 near the mounting hole 43. The protrusion 47 and the hole 49 form rotation regulating means. That is, when the clips 39 are locked to the mounting hole 43, the protrusion 47 is inserted into the hole 49 of the roof board 41.

As shown in FIG. 3, the inside diameter of the hole 49 is larger than the outside diameter of the protrusion 47 in correspondence to the amount of movement s of the movable connector 31.

Now, the function of the movable-connector rotation preventing structure thus designed will be described.

As shown in FIG. 4(A), the clips 39 are inserted into the mounting hole 43 formed in the roof board 41, so that the locking protrusions 39*a* of the clips 39 are locked to the edges of the mounting hole 43. Thus, the movable connector 31 is mounted on the roof board 41 (cf. FIG. 1).

When the movable connector 31 is mounted on the roof board 41 in the above-described manner, the protrusion 47 of the supporting board 35 is inserted into the hole 49 formed in the roof board 41 in such a manner that the protrusion 47 is coaxial with the hole 49. Under this condition, the movable connector 31 is engaged with its mating connector (not shown). In this operation, in order to align the positional shift of the movable connector 31 with respect to the mating connector, the movable connector 31 is moved through the displacement of the clips 39. That is, when the moment acts on the movable connector 31, the connector 31 tends to turn about the inserting central axis of the locking member 37.

If, in this case, the amount of turn of the movable connector exceeds a predetermined range of angles, then the protrusion 47 abuts against the edge of the hole 49, so that the movable connector is prevented from being turned beyond the predetermined range of angles. That is, the protrusion 47 serves as a stopper which prevents the movable connector 31 from being excessively turned. Therefore, by properly selecting the diameters of the protrusion 47 and the hole 49, the maximum allowable rotational angle can be predetermined.

As was described above, with the movable-connector rotation preventing structure of the invention, the supporting board 35 of the movable connector 31 has the protrusion 47, while the roof board 41 has the mounting hole 49. Hence, when the clips 39 are engaged with the mounting hole 43 of the roof board 41, the protrusion 47 is inserted into the hole 49. Therefore, even if the movable connector 31 tends to turn beyond the predetermined range of angles, the protrusion 47 abuts against the edge of the hole 49, thus preventing the movable connector 31 from being turned excessively. This feature positively eliminates the possibility that the movable connector 31 will be greatly displaced to make it difficult to connect the mating connector to the movable connector.

The combination of the protrusion 47 and the hole 49 prevents the movable connector from being excessively turned, and no external force such as twisting force is applied to the clips 39 and the connector housing 33; that is, those components 39 and 33 are prevented from being damaged by such external force.

The movable-connector rotation preventing structure described above functions to prevent the movable connector from being excessively turned; however, it goes without saying that the structure regulates an excessive movement of the movable connector in the direction in which the latter is moved to absorb the positional shift; i.e., in a direction perpendicular to the inserting central axis c. In this case, the clips 39 and the connector housing 33 are more positively protected.

In the above-described rotation regulating means, the protrusion 47 is formed on the movable connector 31, and the hole 49 is formed in the roof board 41; however, the invention is not limited thereto or thereby. That is, the protrusion 47 may be formed on the roof board 41, and the hole 49 may be formed in the movable connector 31 as shown in FIG. 9.

What is claimed is:

1. A connector arrangement having a rotation preventing structure adapted to regulate excessive rotation of a movable connector comprising:

a mounting member having a mounting hole formed therein;

a connector housing;

a locking member protruding from one surface of said connector housing, said locking member being inserted into said mounting hole and locked to said mounting hole; and rotation regulating means cooperatively provided on said mounting member and said connector housing, to regulate the rotation of said movable connector about the inserting central axis of said locking member, wherein said rotation regulating means comprises:

a protrusion extended from one of said connector housing and said mounting member; and a limiting hole formed in the other one said connector housing and said mounting member, said limiting hole engaging said protrusion when said locking member is locked to said mounting hole with a predetermined clearance provided between said protrusion and the inner surface defining said limiting hole, said clearance being formed to allow relative rotation between said connector housing and said mounting member about a pivot axis defined by said locking member to facilitate self-alignment of said connector housing to a mating connector.

2. A connector arrangement as claimed in claim 1, wherein the inside diameter of said limiting hole is larger than the outside diameter of said protrusion.

3. The connector arrangement of claim 1, wherein said connector housing includes a supporting board and wherein said locking member is protruded from one surface of said supporting board.

4. The connector arrangement of claim 3, wherein said rotation regulating means is provided on said supporting board.

5. The connector arrangement of claim 4, wherein said rotation regulating means comprises a protrusion extending from said supporting board and a limiting hole provided in said mounting member.

6. The connector arrangement of claim 1, wherein said locking member includes a plurality of elastic locking clips each having a locking protrusion at a distal end, each said locking protrusion engaging an edge of said mounting hole to retain said connector housing in a spring-like manner.

* * * * *